US010907780B2

(12) United States Patent
Gao

(10) Patent No.: US 10,907,780 B2
(45) Date of Patent: Feb. 2, 2021

(54) NET LAMP AND DECORATIVE LAMP

(71) Applicant: Shangyou Jiayi Lighting Product Co., Ltd., Ganzhou (CN)

(72) Inventor: Rong Gao, Ganzhou (CN)

(73) Assignee: Shangyou Jiayi Lighting Product Co., Ltd., Ganzhou (CN)

( * ) Notice: Subject to any disclaimer, the term of this patent is extended or adjusted under 35 U.S.C. 154(b) by 0 days.

(21) Appl. No.: 16/116,661

(22) Filed: Aug. 29, 2018

(65) Prior Publication Data

US 2019/0368670 A1 Dec. 5, 2019

(30) Foreign Application Priority Data

May 31, 2018 (CN) ..... 2018 1 0549871

(51) Int. Cl.

| | |
|---|---|
| ***F21S 4/15*** | (2016.01) |
| *F21Y 115/10* | (2016.01) |
| *F21S 10/02* | (2006.01) |
| *F21V 23/04* | (2006.01) |

(52) U.S. Cl.

CPC ..... *F21S 4/15* (2016.01); *F21S 10/02* (2013.01); *F21V 23/0407* (2013.01); *F21Y 2115/10* (2016.08)

(58) Field of Classification Search

CPC ..... F21S 4/15; H01R 13/62; H01R 13/627; H01R 25/003

See application file for complete search history.

(56) References Cited

U.S. PATENT DOCUMENTS

| | | | | |
|---|---|---|---|---|
| 5,667,295 | A * | 9/1997 | Tsui | F21V 17/04 362/249.15 |
| 6,106,138 | A * | 8/2000 | Wei | F21S 4/10 362/249.01 |
| 6,217,193 | B1 * | 4/2001 | Won | F21V 21/088 362/123 |
| 2005/0105291 | A1 * | 5/2005 | Wu | F21V 27/02 362/294 |
| 2006/0039142 | A1 * | 2/2006 | Temple | G09F 9/33 362/231 |
| 2015/0077999 | A1 * | 3/2015 | Chen | F21V 23/001 362/249.08 |
| 2017/0114967 | A1 * | 4/2017 | Chen | F21S 4/15 |
| 2018/0119929 | A1 * | 5/2018 | Weiss | B28B 23/0025 |

* cited by examiner

*Primary Examiner* — Timothy J Thompson
*Assistant Examiner* — Amol H Patel

(57) ABSTRACT

A net lamp and a decorative lamp, the net lamp including a plurality of conductive wires, a plurality of insulated wires, a plurality of lamp bodies disposed on the conductive wires, and a plurality of fasteners for fastening the conductive wires and the insulated wires; wherein the plurality of conductive wires and the plurality of insulated wires are connected to form a net-like structure by means of the plurality of fasteners. The decorative lamp includes the above described the net lamp.

12 Claims, 2 Drawing Sheets

NET LAMP AND DECORATIVE LAMP

CROSS-REFERENCE TO RELATED APPLICATIONS

The present application claims the priority to the Chinese patent application with the application number 201810549871.7, filed with the Chinese Patent Office on May 31, 2018, and entitled "Net Lamp and Decorative Lamp", which is incorporated herein by reference in its entirety.

TECHNICAL FIELD

The present disclosure relates to the technical field of illuminating decorative lamps, and particularly to a net lamp and a decorative lamp.

BACKGROUND

String Lamp decorations are very popular in countries outside China, especially on festivals such as Christmas, string lamps are usually wound around places such as in the trees, under the eaves or the like for decorating. In most of the lamp decorations in the early stages, a plurality of lamp bulbs spaced apart from one another are disposed on a single conductive wire, and by plugging one end of the conductive wire to a power supply, it is possible to electrify the entire string lamp to produce the effect of illumination or decorative effect of sparkling. However, for such traditional string lamps, the lighting and illumination effect is monotonous due to the fact that the lamp bulbs arranged in a straight line; moreover, when in use, the string lamp needs to be wound onto a Christmas tree or the like, and needs to be unwound after use, both of which are troublesome and inconvenient.

In modern times, the designs of net lamps with different structural forms have been developed, in which the whole lamp decoration is designed like a net, so that all the lamp bulbs and conductive wires can be easily draped, as a whole, over a place to be decorated (such as Christmas trees and bushes), which is relatively fast; the existing wires for net lamps are all strand wires of transparent PVC-clad copper wire, the lamp beads (miniature bulbs) are traditional direct plug-in LED lamps, the lamps need to be welded one by one, and the connected wires are in disorder.

The information disclosed in this Background Art section is only for enhancement of understanding of the general background art of the present disclosure and should not be taken as an acknowledgment or any form of suggestion that this information forms the prior art already known to a person skilled in the art.

SUMMARY

A first object of the present disclosure is to provide a net lamp (meshwork lamp), which solves the technical problem in the prior art that the connected wires are in disorder.

The net lamp provided by the present disclosure comprises: a plurality of conductive wires, a plurality of insulated wires, a plurality of lamp bodies disposed on the conductive wires, and a plurality of fasteners for fastening the conductive wires and the insulated wires.

The plurality of conductive wires and the plurality of insulated wires are connected to form a net-like structure by means of the plurality of fasteners.

In the technical solutions above, further, each of the fasteners comprises a sheath body or glue which solidifies under ultraviolet irradiation.

In the technical solutions above, further, each of the fasteners is provided as a sheath body, the lamp bodies are located inside the sheath bodies, and the conductive wires and the insulate wires both penetrate the sheath bodies.

In the technical solutions above, further, the conductive wires and the insulated wires are connected in a staggered manner to form a net-like structure.

In the technical solutions above, further, each of the sheath bodies is provided as a transparent sheath body.

In the technical solutions above, further, each of the fasteners is provided as a sheath body, the lamp bodies are located outside the sheath bodies, and the conductive wires connected at the lamp bodies are tightened (clamped tight) by the sheath bodies; and the insulated wires are also tightened by the sheath bodies.

In the technical solutions above, further, the conductive wires and the insulated wires are connected in a staggered manner to form a net-like structure.

In the technical solutions above, further, each of the sheath bodies is provided as an elastic sheath body.

In the technical solutions above, further, an outer layer of each of the conductive wires is wrapped by a protective layer.

A second object of the present disclosure is to provide a decorative lamp, which solves the technical problem in the prior art that the connected wires are in disorder.

The decorative lamp provided by the present disclosure comprises the net lamp as described above.

Compared with the prior art, the net lamp and the decorative lamp provided in the present disclosure have the following advantages:

The net lamp provided in the present disclosure comprises a plurality of conductive wires, a plurality of insulated wires, a plurality of lamp bodies disposed on the conductive wires, and a plurality of fasteners for fastening the conductive wires and the insulated wires; wherein the plurality of conductive wires and the plurality of insulated wires are connected to form a net-like structure by means of the plurality of fasteners. With the arrangement of the insulated wires, at the time of weaving a net-like structure, it is possible to form an ordered net-like structure by connection, so as to avoid the problem that the connected wires are in disorder.

In addition, the lamp bodies are located inside the sheath bodies, and the conductive wires and the insulate wires both penetrate the sheath bodies. In the process of weaving the net-like structure, one conductive wire and one insulated wire are sequentially passed through a sheath body first, and then other conductive wires and insulated wires are sequentially passed through sheath bodies, so that the conductive wires and the insulated wires form an ordered net-like structure after the connection.

Furthermore, the lamp bodies are located outside the sheath bodies, and the conductive wires connected at the lamp bodies are tightened by the sheath bodies. In the process of weaving the net-like structure, one of the lamp bodies on a conductive wire is passed through a sheath body so that the lamp body is located outside the sheath body, then the sheath body fixes the conductive wire located inside the sheath body, at the same time the insulated wire is inserted inside the sheath body, the insulated wire located inside the sheath body is fixed by the sheath body, and then the other conductive wires and insulated wires are sequentially connected in this manner to finally form the ordered net-like structure.

The decorative lamp provided in the present disclosure comprises the net lamp as described above. Due to the arrangement of the net lamp, the decorative lamp has all the advantages of the net lamp as described above. With the arrangement of the insulated wires, at the time of weaving a net-like structure, it is possible to form an ordered net-like structure by connection, so as to avoid the problem that the connected wires are in disorder.

BRIEF DESCRIPTION OF THE DRAWINGS

In order to more clearly illustrate the technical solutions of the embodiments of the present disclosure or in the prior art, brief description is made below on the drawings required to be used in the description of the embodiments or the prior art. Obviously, the following drawings only illustrate some of the embodiments of the present disclosure, and for a person of ordinary skills in the art, other drawings may be obtained from these drawings without inventive effort.

Reference signs: 100—conductive wire; 200—lamp body; 300—insulated wire; 400—sheath body.

DETAILED DESCRIPTION OF THE INVENTION

The technical solutions of the present disclosure will be clearly and completely described below with reference to the drawings. Obviously, the embodiments described are only some of the embodiments of the present disclosure, rather than all of the embodiments of the present disclosure. All the other embodiments that are obtained by a person of ordinary skills in the art on the basis of the embodiments of the present disclosure without inventive effort shall be covered by the protection scope of the present disclosure.

In the description of the present disclosure, it is to be noted that the orientational or positional relations denoted by the terms such as "center", "upper", "lower", "left", "right", "vertical", "horizontal", "inner" and "outer" are based on the orientational or positional relations indicated by the figures, which only serve to facilitate describing the present disclosure and simplify the description, rather than indicating or implying that the device or element referred to must have a particular orientation, and is constructed and operated in a particular orientation, and therefore cannot be construed as a limitation on the present disclosure. In addition, the terms "first" and "second" only serve the purpose of description and cannot be understood as an indication or implication of relative importance.

In the description of the present disclosure, it is to be noted that unless otherwise explicitly specified and defined, the terms "install", "link" and "connect" shall be understood in a broad sense, which may, for example, refer to fixed connection, detachable connection or integral connection; may refer to mechanical connection or electrical connection; may refer to direct connection or indirect connection by means of an intermediate medium; and may refer to communication between two elements. A person of ordinary skills in the art could understand the specific meaning of the terms in the present disclosure according to specific situations.

The present disclosure will be described in further detail below by way of specific embodiments and with reference to the accompanying drawings.

Embodiment I

Figure 1:
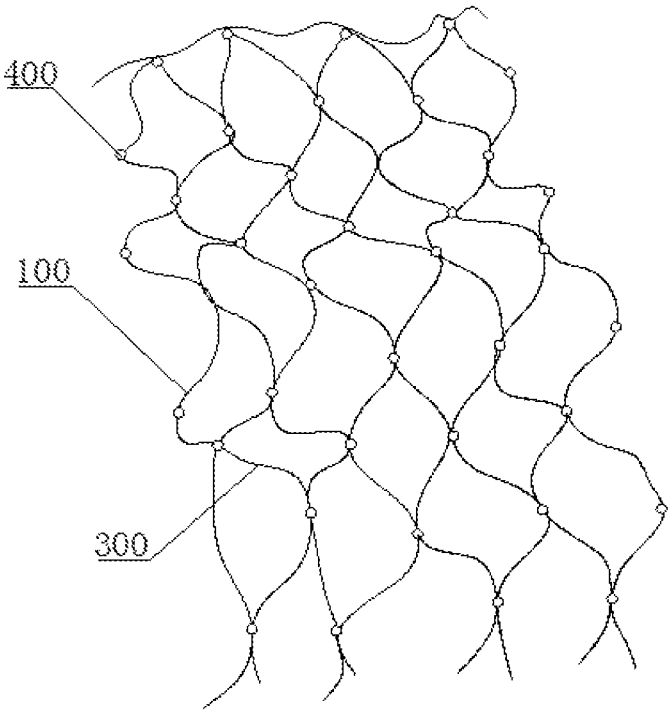
FIG. 1 is a schematic structural diagram of a net lamp provided in an embodiment of the present disclosure.

FIG. 1 is a schematic structural diagram of a net lamp provided in an embodiment of the present disclosure, which mainly reflects the net lamp as a whole after the connection of the conductive wires and the insulated wires.

Figure 2:
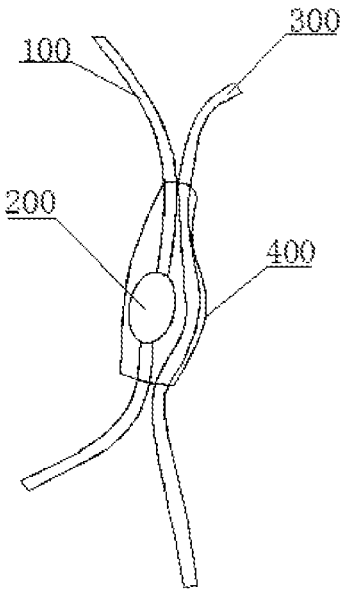
FIG. 2 is a partially enlarged view of the net lamp of FIG. 1 provided in the present disclosure.

FIG. 2 is a partially enlarged view of the net lamp of FIG. 1 provided in the present disclosure, which mainly shows the structure inside the sheath body to facilitate clear observation of the positional relation between a conductive wire and an insulated wire inside a sheath body.

As shown in FIG. 1 and FIG. 2, the net lamp provided in this embodiment comprises a plurality of conductive wires 100, a plurality of insulated wires 300, a plurality of lamp bodies 200 disposed on the conductive wires 100, and a plurality of fasteners for fastening the conductive wires 100 and the insulated wires 300; wherein the plurality of conductive wires 100 and the plurality of insulated wires 300 are connected to form a net-like structure by means of the plurality of fasteners.

It is to be noted that, in the existing designs, for the prior art net lamps, LED lamps are connected to a conductive wire 100 and a plurality of conductive wires 100 carrying the LED lamps are connected to form a net-like structure, the resultant net-like structure is in disorder, and the connection process is also complicated; then there is a need for the net lamp described above, in which an ordered net-like structure can be obtained by connecting the conductive wires 100 and the insulated wires 300.

In the above, each of the fasteners is provided as a sheath body 400.

Specifically, the lamp bodies 200 are located inside the sheath bodies 400, and the conductive wires 100 and the insulate wires 300 both penetrate the sheath bodies 400.

Further, the conductive wires 100 and the insulated wires 300 are connected in a staggered manner to form the net-like structure.

It should be noted that, in the process of weaving the net-like structure, one conductive wire 100 and one insulated wire 300 are sequentially passed through one of the sheath bodies 400 first, and then other conductive wires 100 and insulated wires 300 are sequentially passed through other sheath bodies 400, as shown in FIG. 1, so that the conductive wires 100 and the insulated wires 300 form an ordered net-like structure after the connection.

It should further be noted that the conductive wires 100 and the insulated wires 300 are arranged sequentially, i.e., arranged at intervals from left to right as shown in FIG. 1.

It should further be noted that the lamp bodies 200 are provided as LED lamps emitting light in various colors and having various sizes and various degrees of brightness.

Still further, each of the sheath bodies 400 is provided as a transparent sheath body 400, and the arrangement of the transparent sheath body 400 will not hinder the lamp bodies 200 from emitting light.

It should be noted that the each of sheath bodies 400 is provided as an elastic sheath body 400; the arrangement of the elastic sheath bodies 400 can facilitate clamping tightly the conductive wires 100 and the insulated wires 300.

It should further be noted that each of the sheath bodies 400 may also be provided as a heat-shrinkable sleeve so that the insulated wires 300 combined with the string lamps form different shapes, or may be provided in other materials, as long as the production thereof is convenient and quick.

It should further be noted that an outer layer of each of the conductive wires 100 is wrapped by a protective layer, which can prevent the conductive wire 100 from being damaged.

It should also be noted that, the conductive wires 100 may be provided as enameled wires, the protective layers thereof are polished off by a machine, the conductive wires can be welded with lamp beads after solder paste sticks to the conductive wires, and then the surfaces of the lamp beads are sealed with protective glue; mechanical automatic production is implemented throughout the process, and the production is rapid.

As can be seen from the above detailed description of the present disclosure, the net lamp provided in this embodiment comprises a plurality of conductive wires 100, a plurality of insulated wires 300, a plurality of lamp bodies 200 disposed on the conductive wires 100, and a plurality of sheath bodies 400 for fastening the conductive wires 100 and the insulated wires 300; wherein the plurality of conductive wires 100 and the plurality of insulated wires 300 are connected to form a net-like structure by means of the plurality of sheath bodies 400. With the arrangement of the insulated wires 300, at the time of weaving the net-like structure, it is possible to form an ordered net-like structure, so as to avoid the problem that the connected wires are in disorder.

Embodiment II

Figure 3:
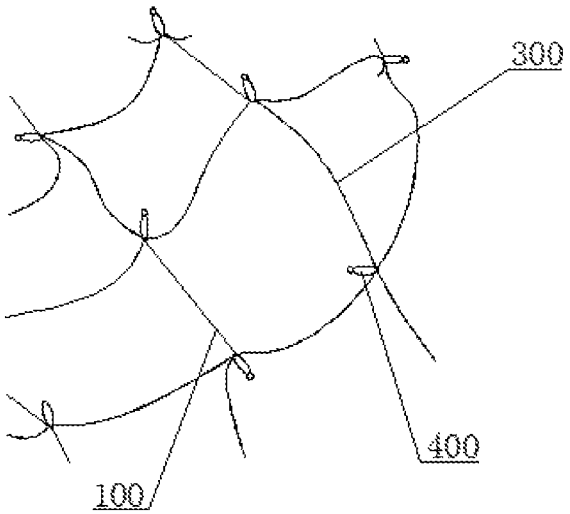
FIG. 3 is another schematic structural diagram of a net lamp provided in an embodiment of the present disclosure.

FIG. 3 is another schematic structural diagram of a net lamp provided in an embodiment of the present disclosure, which mainly reflects the net lamp as a whole after the connection of the conductive wires and the insulated wires.

Figure 4:
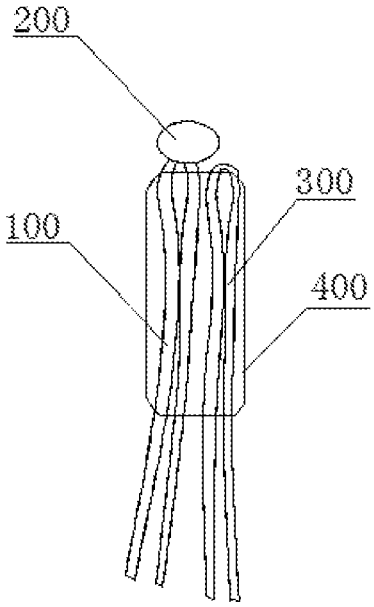
FIG. 4 is a partially enlarged view of the net lamp of FIG. 3 provided in the present disclosure.

FIG. 4 is a partially enlarged view of the net lamp of FIG. 3 provided in the present disclosure, which mainly shows the structure inside the sheath body to facilitate clear observation of the positional relation between a conductive wire and an insulated wire inside a sheath body.

As shown in FIG. 3 and FIG. 4, the net lamp provided in this embodiment comprises a plurality of conductive wires 100, a plurality of insulated wires 300, a plurality of lamp bodies 200 disposed on the conductive wires 100, and a plurality of fasteners for fastening the conductive wires 100 and the insulated wires 300; wherein the plurality of conductive wires 100 and the plurality of insulated wires 300 are connected to form a net-like structure by means of the plurality of fasteners.

In the above, each of the fasteners is provided as a sheath body 400.

Specifically, the lamp bodies 200 are located outside the sheath bodies 400, and the conductive wires 100 connected at the lamp bodies 200 are tightened by the sheath bodies 400.

Further, the insulated wires 300 are also locked by the sheath bodies 400.

It should be noted that the conductive wires 100 and the insulated wires 300 are connected in a staggered manner to form the net-like structure The other structures of the present embodiment are the same as those of embodiment I, and therefore will not be further described herein.

As can be seen from the above detailed description of the present disclosure, for the net lamp provided in this embodiment, with the arrangement of the insulated wires 300, at the time of weaving the net-like structure, it is possible to form an ordered net-like structure, so as to avoid the problem that the connected wires are in disorder. Moreover, the lamp bodies 200 are located outside the sheath bodies 400, and the conductive wires 100 connected at the lamp bodies 200 are tightened by the sheath bodies 400. In the process of weaving the net-like structure, one of the lamp bodies 200 on a conductive wire 100 is passed through a sheath body 400 so that the lamp body 200 is located outside the sheath body 400, then the sheath body 400 fixes the conductive wire 100 located inside the sheath body 400, at the same time the insulated wire 300 is inserted inside the sheath body 400, the insulated wire 300 located inside the sheath body 400 is fixed by the sheath body 400, and then the other conductive wires 100 and insulated wires 300 are sequentially connected in this manner to finally form the ordered net-like structure.

Embodiment III

The net lamp provided in this embodiment comprises a plurality of conductive wires 100, a plurality of insulated wires 300, a plurality of lamp bodies 200 disposed on the conductive wires 100, and a plurality of fasteners for fastening the conductive wires 100 and the insulated wires 300; wherein the plurality of conductive wires 100 and the plurality of insulated wires 300 are connected to form a net-like structure by means of the plurality of fasteners.

In the above, each of the fasteners is provided as glue which solidifies under ultraviolet irradiation.

It should be noted that at the time of connecting the conductive wires 100 with the insulated wires 300, the glue is dripped onto a position of a conductive wire 100 where a lamp body 200 is disposed, at the moment, the conductive wire 100 at this place is brought into contact with the insulated wire 300, after the dripping of the glue is finished, the glue is irradiated with ultraviolet rays, so that the glue solidifies, then the other conductive wires 100 and insulated wires 300 are sequentially connected in the above-described manner to finally form an ordered net-like structure.

It should further be noted that the glue is UV glue, AB glue, etc.

The other structures of the present embodiment are the same as those of embodiment I, and therefore will not be further described herein.

Embodiment IV

The decorative lamp provided in this embodiment comprises the net lamp as described above.

The decorative lamp provided in this embodiment comprises the net lamp as described above. Due to the arrangement of the net lamp, the decorative lamp has all the advantages of the net lamp as described above; with the arrangement of the insulated wires 300, at the time of weaving a net-like structure, it is possible to form an ordered net-like structure, so as to avoid the problem that the connected wires are in disorder.

Finally, it should be noted that the above embodiments are only used to illustrate the technical solutions of the present disclosure, rather than limit the same; although the present disclosure has been described in detail with reference to the foregoing embodiments, it should be understood by a person of ordinary skills in the art that the technical solutions described in the embodiments can still be modified, or equivalent substitution can be made to some or all of the technical features therein; and the modification or substitution would not cause the substance of the corresponding technical solutions to get out of the scope of the technical solutions of the embodiments of the present disclosure.

Moreover, a person skilled in the art will appreciate that while some embodiments described herein include some but not other features included in other embodiments, combinations of features of different embodiments are meant to be within the scope of the disclosure, and form different embodiments. For example, in the following claims, any one of the claimed embodiments may be used in any combination. The information disclosed in this Background section is only for enhancement of understanding of the general background of the present disclosure and should not be taken as an acknowledgment or any form of suggestion that this information forms the prior art already known to a person skilled in the art.

What is claimed is:

1. A net lamp comprising:

a plurality of conductive wires, a plurality of insulated wires, a plurality of lamp bodies disposed on the conductive wires, and a plurality of fasteners for fastening the conductive wires and the insulated wires, wherein the plurality of conductive wires and the plurality of insulated wires are connected to form a net-like structure by means of the plurality of fasteners, each of the fasteners being provided as a sheath body; and wherein the lamp bodies are adjustably disposed outside the sheath bodies, and each of the sheath bodies is provided as a heat-shrinkable sleeve.

2. The net lamp according to claim 1, wherein the conductive wires and the insulated wires a connected in a staggered manner to form the net-like structure.

3. The net lamp according to claim 2, wherein each of the sheath bodies is provided as an elastic sheath body.

4. The net lamp according to claim 1, wherein an outer layer of each of the conductive wires is wrapped by a protective layer.

5. The net lamp according to claim 4, wherein each of the sheath bodies is provided as an elastic sheath body.

6. The net lamp according to claim 1, wherein each of the sheath bodies is provided as an elastic sheath body.

7. A decorative lamp comprising a net lamp, the net lamp comprising:

a plurality of conductive wires, a plurality of insulated wires, a plurality of lamp bodies disposed on the conductive wires, and a plurality of fasteners for fastening the conductive wires and the insulated wires, wherein the plurality of conductive wires and the plurality of insulated wires are connected to form a net-like structure by means of the plurality of fasteners, each of the fasteners being provided as a sheath body; and wherein the lamp bodies are adjustably disposed the outside the sheath bodies, and each of the sheath bodies is provided as a heat-shrinkable sleeve.

8. The decorative lamp according to claim 7, wherein an outer layer of each of the conductive wires is wrapped by a protective layer.

9. The decorative lamp according to claim 8, wherein each of the sheath bodies is provided as an elastic sheath body.

10. The decorative lamp according to claim 7, wherein the conductive wires and the insulated wires are connected in a staggered manner to form the net-like structure.

11. The decorative lamp according to claim 10, wherein each of the sheath bodies is provided as an elastic sheath body.

12. The decorative lamp according to claim 7, wherein each of the sheath bodies is provided as an elastic sheath body.

* * * * *